US009739522B2

(12) United States Patent
Chauvin et al.

(10) Patent No.: US 9,739,522 B2
(45) Date of Patent: Aug. 22, 2017

(54) DEVICE FOR LIFTING CONDENSATES, IMPLEMENTING A BACTERICIDAL METAL

(71) Applicant: Sauermann Industrie SA, Chevry Cossigny (FR)

(72) Inventors: Antoine David Chauvin, Champigny sur Marne (FR); Olivier De Gea, Saint-Michel sur Orge (FR); Jean-Pierre Chenard, Ollainville (FR)

(73) Assignee: SAUERMANN INDUSTRIE SA, Chevry Cossigny (FR)

( * ) Notice: Subject to any disclaimer, the term of this patent is extended or adjusted under 35 U.S.C. 154(b) by 384 days.

(21) Appl. No.: 14/357,106

(22) PCT Filed: Nov. 8, 2012

(86) PCT No.: PCT/EP2012/072202

§ 371 (c)(1),
(2) Date: May 8, 2014

(87) PCT Pub. No.: WO2013/068510

PCT Pub. Date: May 16, 2013

(65) Prior Publication Data

US 2014/0326015 A1 Nov. 6, 2014

(30) Foreign Application Priority Data

Nov. 8, 2011 (FR) ..... 11 60151

(51) Int. Cl.
*F25D 21/14* (2006.01)
*F24F 13/22* (2006.01)

(52) U.S. Cl.
CPC ..... *F25D 21/14* (2013.01); *F24F 13/222* (2013.01); *F24F 2013/228* (2013.01)

(58) Field of Classification Search
CPC .... F24F 13/222; F24F 2013/228; F25D 21/14
See application file for complete search history.

(56) References Cited

U.S. PATENT DOCUMENTS 5,152,154 A * 10/1992 Sullivan ..... F24F 1/0007 220/571
2007/0119503 A1* 5/2007 Scaringe ..... B60H 1/3233 137/247.41

FOREIGN PATENT DOCUMENTS

EP 1835236 A1 9/2007
EP 1840475 A1 10/2007
(Continued)

OTHER PUBLICATIONS

Machine Translation of JP 2011-153811, published Aug. 11, 2011.*
(Continued)

*Primary Examiner* — Cassey D Bauer
(74) *Attorney, Agent, or Firm* — Amanda M. Prose; Westman, Champlin & Koehler, P.A.

(57) ABSTRACT

A device is provided for lifting condensates. The device includes a container in which condensates are collected and a lift pump for discharging the condensates present in the container. The container is covered on at least one portion of the submerged inner walls thereof with a biocidal surface treatment and contains at least one wire element made from a bactericidal metal material. The wire element has a diameter of between 0.01 mm and 1 mm and a length chosen in such a way as to provide a contact surface greater than the surface area of the container in contact with the condensates.

12 Claims, 1 Drawing Sheet

(56) References Cited

FOREIGN PATENT DOCUMENTS

| | | | | | |
|---|---|---|---|---|---|
| EP | 2085711 | A2 | | 5/2009 | |
| JP | S63201439 | A | | 8/1988 | |
| JP | 5-180536 | | * | 7/1993 | ..... F25B 39/02 |
| JP | 2001248858 | A | | 9/2001 | |
| JP | 2003343873 | A | | 12/2003 | |
| JP | 2006322677 | A | | 11/2006 | |
| JP | 2008116083 | A | | 5/2008 | |
| JP | 2011153811 | A | | 8/2011 | |

OTHER PUBLICATIONS

International Search Report and Written Opinion in English dated Jan. 17, 2013 for corresponding International Patent Application No. PCT/EP2012/072202, filed Nov. 8, 2012, 10 pages.

* cited by examiner

DEVICE FOR LIFTING CONDENSATES, IMPLEMENTING A BACTERICIDAL METAL

CROSS-REFERENCE TO RELATED APPLICATIONS

This application is a Section 371 National Stage application of International Application No. PCT/EP2012/072202, filed Nov. 8, 2012, which is incorporated by reference in its entirety and published as WO 2013/068510 on May 16, 2013, not in English.

FIELD OF THE DISCLOSURE

The field of the invention is that of condensate removal devices to be implemented especially in air-conditioning systems, refrigeration systems, ventilation systems or heating systems.

In these different systems or installations, the condensates resulting from the condensation of the steam present in the ambient air that is cooled, are generally recovered in a container, or more generally in a recovery receptacle which, in certain cases, can be a simple collection panel. The condensates recovered need to be discharged, especially to avoid overflow from the recovery receptacle. This can be done by gravity, for example by means of a rigid or semi-rigid pipe connected to a system for the discharge of waste water or by pumping out the condensates collected in the recovery receptacle.

The invention applies more particularly to this case.

More specifically, the invention relates to the fight against the formation of biofilms in such pumps, especially in the container or pan for recovering condensates.

BACKGROUND OF THE DISCLOSURE

A biofilm is a matrix that is aqueous to more than 95%, gelatinous and secreted by bacteria in water in order to foster their proliferation.

It has been observed that the formation of biofilm is related especially to the following four parameters:

- the ideal temperature for the biofilm to develop, between 15 to 45° C.;
- stagnation or motion in the liquid;
- receptivity of the support, i.e. especially its surface state, the presence of scaling or corrosion, etc;
- the presence of favorable nutrients (especially organic residues).

A major growth of biofilm is often noted in condensate recovery containers. This biofilm can also grow in gravity pipes designed to convey condensates into the container, especially when the section and the slope are too small. This causes the clogging of the pipes which can be filled with biofilm entirely or to a large extent.

In the same way, in a container, the presence of biofilm limits the volume available for the condensates and can disturb or even prevent the efficient working of a removal pump.

Besides, naturally, for hygiene and health, it is not desirable to allow such bacteria-friendly biofilms to develop. For example, biofilm can often be found in the recovery containers of removal pumps associated with refrigerated display cases, for example in supermarkets.

In order to delay the formation of biofilm in containers, there are known ways of placing antibacterial agents in these containers. Such methods are described for example in the documents EP 1 840 475, US 2007 119 503 and EP 2 085 711. In general, the efficacy of these methods against the appearance of biofilm is only temporary. Besides, these methods are costly because they require the regular adding of chemical products into the containers. Because of this, they are also not very environment-friendly.

Other documents such as the document EP 1 835 236 mention the implementation of biocide surface treatment on the walls of a container to prevent biofilm from forming on them. In the same way, the efficacy of such treatment is only temporary, since the surfaces ultimately get colonized by the biofilm all the same.

Certain metals, such as copper or silver, are often considered to be toxic for bacteria. However, their efficacy is still a matter of dispute. Thus, the Internet site www.girpi.fr indicates that "all materials can be colonized by microorganisms, including copper which is nevertheless wrongly considered to be bactericidal". Besides, it has indeed been observed that the use of copper pipes does not prevent the formation of biofilm.

Certain removal pump manufacturers also integrate copper elements that are unsuccessful in preventing the formation of biofilm: it is indeed necessary to clean the filters periodically and use a biocide product that has to be regularly replaced.

SUMMARY

An aspect of the present disclosure relates to a device for removing condensates, comprising a container in which the condensates are collected and a removal pump providing for the discharge of the condensates present in said container.

According to the invention, said container is covered on at least a part of its immersed internal walls with a biocide surface treatment and contains at least one wire element made out of a bactericidal metal material having a diameter of 0.01 mm to 1 mm, and a length chosen so as to provide a contact surface area greater than half of the surface area of said container in contact with said condensates.

The inventor has indeed observed that the use of copper pipes or pieces of copper is ineffective and that biofilms develop in the tub in the same way and in the same proportions as when this metal is absent. By way of an indication, it can be specified that such a copper tube has a contact surface area of the order of 0.5 $dm^2$ for a length of 50 mm and a diameter of 14×16 mm.

By contrast, when the contact surface area exceeds a critical value that depends on the volume of liquid (condensates) to be treated, it appears that the growth of biofilm in the container greatly diminishes even after a utilization time of one or more months.

Thus, it is desirable that the contact surface area should be at least greater than half of the surface area of said container in contact with said condensates. It is even desirable, although not indispensable, that this contact surface area should be at least greater than the surface area of said container in contact with said condensates. Besides, it is desirable that this metal surface area should be properly distributed in the liquid.

The use of metal in wire form makes it possible, in a relatively compact volume, to maximize a surface area of contact. Besides, the easy folding of the metal wires advantageously enables this metal to be distributed over a large part of the container. Furthermore, the presence of these wire elements, owing to their small diameter, ensures efficient contact without any risk of adversely affecting the flow at the inlet and outlet from the container.

Finally, the implementation of a biocide surface treatment on a part of the immersed internal walls of the container, and preferably on the totality of these immersed internal walls, makes it possible, in combination with the use of bactericidal metal wires, to very efficaciously delay the appearance of biofilm.

Advantageously, said wire element takes the form of a coil, a ball, wool, a brush and/or a screen.

Advantageously, said wire elements take the form of multi-strand cables.

Again, this approach gives a big surface area of contact with the liquid.

Said metal can especially belong to the group comprising copper, silver or any alloy containing at least one of these two metals. Copper especially has the advantage of having a reasonable cost for this application.

Thus, for example, the metal can be constituted by electrical copper cables.

Advantageously, the wire elements used are silver-plated copper or brass wires. These wires indeed are highly efficacious in preventing the formation of biofilm.

According to one particular embodiment, means are planned for the activation and/or acceleration of the bactericidal action of said metal. These means can belong especially to the group comprising:

means ensuring acid attack;

means ensuring thermal attack;

means ensuring oxidation-reduction or redox action;

means ensuring a passage of current.

Preferably, said biocide surface treatment comprises the application of a biocide paint diffusing copper salts.

Advantageously, this biocide surface treatment is applied also to the immersed parts present inside said container. It thus advantageously enables all the surfaces of the device which are in contact with the condensate to be covered by this surface treatment.

According to another advantageous embodiment, said biocide surface treatment comprises an in-depth treatment, for example using special additives for plastic materials and/or by surface structuring, for example by means of a nanostructure or a nanocomposite material.

Advantageously, this in-depth treatment is applied also to the immersed parts present inside said container. It thus advantageously enables all the surfaces of the device that are in contact with the condensates to be protected by this in-depth treatment.

The invention also pertains to installations, especially refrigeration, heating and/or air-conditioning installations comprising at least one condensate removal device as described here above.

BRIEF DESCRIPTION OF THE DRAWINGS

Other characteristics shall appear more clearly from the following description of a particular embodiment, given by way of a simple illustratory and non-exhaustive example, and from the appended figures, of which.

DETAILED DESCRIPTION OF ILLUSTRATIVE EMBODIMENTS

During experiments, the inventor has observed that a mass of copper, even a big mass of the order of 30 grams, placed in the container of a removal pump with a classic volume of liquid (0.25 l to 0.40 l) has practically no effect on the formation of biofilm. Indeed, since the copper surface in contact with water is not enough to totally prevent the formation of biofilm, this biofilm can be formed especially on the copper surface itself. This totally removes the efficacy of copper in preventing the formation of more biofilm. Thus, there is substantially the same quantity of biofilm, with or without the presence of this copper mass.

However, the inventor has observed that, surprisingly, the formation of biofilm is significantly delayed if a similar quantity by weight of copper is placed in the container in the form of wires or filaments. More specifically, the inventor has observed that is necessary to place the bactericidal metal, for example copper, in such a way as to maximize the surface area of contact between the metal and water, in order to exceed a critical threshold beyond which the metal becomes efficacious and therefore bactericidal.

Indeed, the wire form of the metal enables it to offer a very great surface area of contact with the water. Besides, the structure of a metal wire enables it to be easily folded in any chosen shape and to preserve this shape. The use of a wire therefore makes it very easy to place a large surface area of contact in the container, distributed throughout the container, in contact with the water even when this container has an unusual shape.

Figure 1:
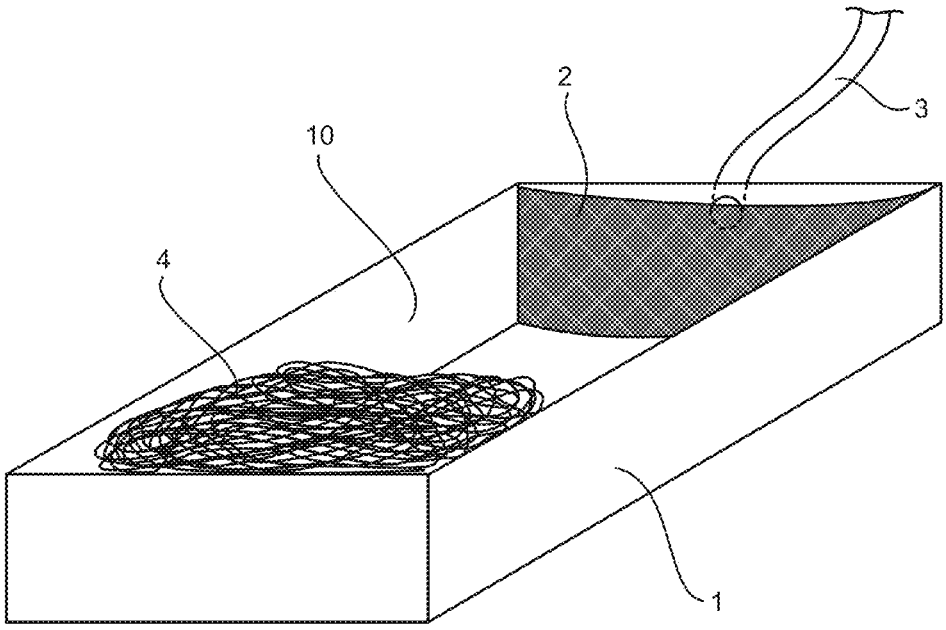
FIG. 1 is a schematic representation of a possible embodiment of the invention.

Thus, as illustrated in FIG. 1, the pan or container 1 collects condensates delivered by the tube 2. A filter 3 can be planned to stop any excessively sized element that could block or damage the pump. The filter 3 can also be at least partly made of bactericidal metal and participate in the contact surface area.

This pump, which is not shown, can be of any type known in the field of condensate removal. It is placed in or on the pan 1 to which it can be fixedly attached. Its shape can especially be adapted to completely cover the pan, and means of reversible fixed attachment to this pan can be planned.

According to one simple and low-cost embodiment, the copper can take the form of electrical wires 4, preferably multi-strand wires. In this case, it may be useful to separate the strands ("untwist" the wire) to increase the contact surface area. It must be noted that, if the electrical wires are shown only in a part of the container, they can be placed in the greatest part of the container. The ease with which such wires can be folded indeed makes it possible to distribute them in the container in circumventing the pump introduced into the container.

Figure 2:
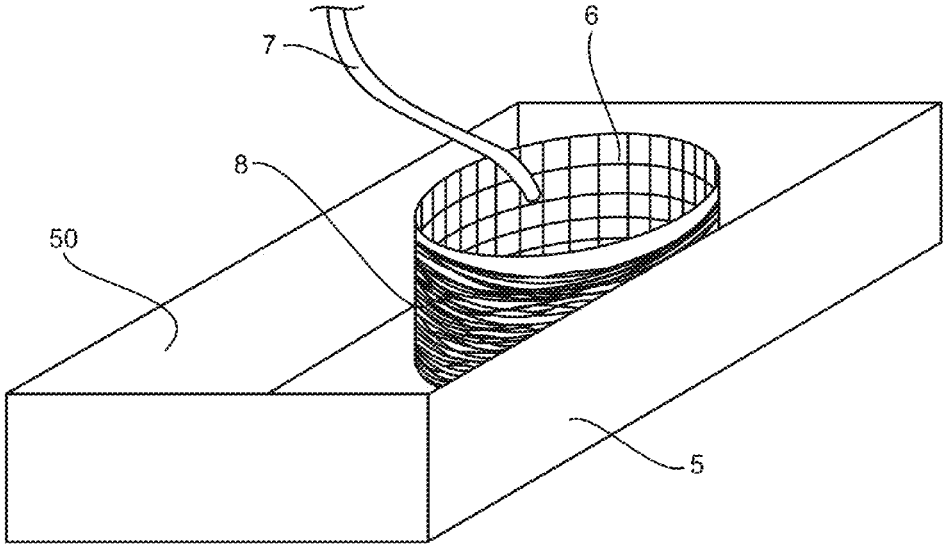
FIG. 2 is a schematic representation of another possible embodiment of the invention.

According to another possible embodiment of the invention shown in FIG. 2, the condensates can be conveyed by a pipe 7 into a basket 6 placed in the container 5. This basket 6 can for example be a shape in the form of a screen to enable the easy flow of the condensates into the container 5. In this embodiment, the bactericidal metal wire 8 is wound around the basket 6. Thus, the totality of the liquid flowing from the basket 6 into the container 5 flows through the windings of bactericidal metal wires. In this embodiment, the wires wound around the basket 6 fulfill the role of a filter.

In general, since the presentation in the form of metal wires is very classic and easy to manufacture, the implementation of such wires in a container can be done for a cost far lower than that of the prior art solutions.

Depending on the diameter and layout of the metal wires placed in the container, they can take a form approaching that of wool, fibers or knit metal or again metal canvas as used in certain sieves or filters.

The dimensions of the wire which must be placed in the container vary greatly, especially as a function of the dimensions of the container. However, in general, this wire has a diameter of 0.01 mm to 1 mm and a length chosen so as to provide a contact surface area greater than half of the surface area of the container in contact with the condensates. Preferably, this surface area is even greater than the surface area of the container in contact with the condensates.

In one possible embodiment, for a container of the order of 1.5 liters, it is planned to have a contact surface area of the order of 6.9 $dm^2$, provided by 220 meters of silver-coated copper wire with a diameter of 0.1 mm.

In another particular embodiment, for a container having a ground surface area of the order of 2.2 $dm^2$, and a volume of 0.26 l (when the pump is stopped) to 0.40 l (when the pump is put into operation), a contact surface area of the order of 5 to 10 $dm^2$ is planned.

In another embodiment, for a container of the order of a few milliliters (for example 10 to 30 ml), it can be planned to use a length smaller than 1 meter of a wire with a diameter of the order of 0.01 mm.

It can be understood that the minimum contact surface area depends on the volume of liquid to be treated.

In general, and by way of an indication, since the different applications for which the implementation of the invention is envisaged use containers that can have a volume of 0.005 to 20 liters, it is possible to envisage the use of wire with a length of 0.1 to 5000 m and a diameter of 0.01 to 1 mm.

Other bactericidal metals known to those skilled in the art can be used instead of copper or silver or their combination. It is possible especially to use any other metal or support made or not made of metal, capable of receiving a plating of silver or copper or of an alloy containing at least one of these two metals.

Besides, it is possible to plan for means of activation and/or acceleration of the bactericidal action of the metal, especially by activating its oxidation. Thus, the metal can be subjected for example to an acid attack, a thermal attack, an oxide reduction or redox action, a passage of current, etc.

To complement the action of the bactericidal metal in its wire form, the walls of the container which are in contact with the liquid are subjected to a biocide surface treatment. Thus, the internal wall of the container 1 or the internal wall 50 of the container 5 can be subjected to biocide treatment. These walls can for example be lined with a resin coating in which the biocide agents are inserted.

According to another possible embodiment, the walls can be treated in depth, a special biocide additive being inserted into the plastic forming the walls and diffusing through this plastic. According to yet another possible embodiment, the surface treatment can be done by surface structuring, for example by means of a nanostructure or a nanocomposite material.

Preferably, the entire immersed internal surface is thus treated. It is possible however, although less efficacious, for the treatment to be limited to a part of this surface, for example limited to the parts of this surface that are most liable to be colonized by the biofilm.

The application of such a treatment is known in itself to prevent the formation of biofilm. However, this treatment did not delay the appearance of biofilm except for a limited duration.

The combination of this surface treatment and the implementation of a wire element of great length and of small diameter gives an efficacious result over a substantial period of time, unlike in the prior-art techniques.

Indeed, the surface treatment and the presence of biocide in the container were hitherto considered to be alternatives in the fight against the appearance of biofilms. Both these treatments alike prevent the appearance of biofilm in a container for a limited period, generally of the order of three months. Those skilled in the art had no reason to think that the combined use of these prior-art methods, which are functionally opposed to each other (as the surface treatment generally has the function of facilitating the acceleration of the flow while the presence of a biocide in the container tends to disturb and slow down this flow), would prevent the appearance of the biofilm for a period far greater than the period of efficacy of the different methods taken individually.

However, it has emerged that the combination of a biocide surface treatment with the presence of a biocide metal in wire form providing for a major surface area of contact with water efficaciously delays the appearance of biofilm for a duration far greater than the duration in which a biocide surface treatment alone or the implementation of a biocide metal alone are efficacious.

Thus, the following table represents the results of tests of operation that were conducted by the inventors on condensate removal devices comprising a container, in which the condensates are collected, and a removal pump. Different methods for combating the appearance of biofilms were regularly observed on these devices in order to determine the time it takes for a biofilm to grow therein.

It can thus be seen ("test 1" column) that the biofilm appears very rapidly (within about five weeks) in the device when no method aimed at preventing its formation is applied.

The use of copper in the container ("test 2" column) slightly delays the appearance of this biofilm (to about seven weeks). Other approaches known per se ("test 3" column to "test 5" column) delays the appearance of this biofilm for up to about three months).

Those skilled in the art therefore had no indication that certain combinations of these same methods ("test 6" and "test 7" columns) would delay the appearance of this biofilm for an appreciably greater time (for up to more than six months without particular optimization) as the inventors have discovered. Those skilled on the art had even less of such an indication since the techniques, in principle, have an opposite mode of action (some of them hindering the circulation of the liquid while others seek to facilitate the sliding of the fluids on the walls).

It also appeared thereafter ("test 8" and "test 9" columns) that the optimizing of this method, especially by the surface treatment of all the immersed parts rather than of the container alone, further improved these results.

It can be noted that, under these conditions, the duration (of the order of 12 months) is not only greater than the duration corresponding to only one of the means (about three months—tests 3 to 5) but even greater than the sum of these durations (about six months) whereas nothing had suggested that these durations could be all added up together. Rather it was the contrary that was indicated.

Indeed, it appears surprisingly that the results obtained are even better: the effects of the two means get combined and amplified and their synergy multiplies at least by 4 the duration associated with each of them to reach at least 12 months.

| Test number | 1 | 2 | 3 | 4 | 5 | 6 | 7 | 8 | 9 |
|---|---|---|---|---|---|---|---|---|---|
| Duration of test (weeks) | 5 | 7 | 14 | 14 | 14 | 19 | 29 | 32 à 56 | 56 |
| Number of devices tested | 25 | 7 | 5 | 6 | 1 | 3 | 6 | 3 | 3 |
| Copper in pieces or in wire form | | x | | | | | | | |
| Silver-plated copper | | | | | x | x | x | x | x |
| Biocide paint on the container | | | x | | | x | | | x |
| Biocide paint on all the immersed parts | | | | | | | | | x |
| In-depth treatment plastic of the container | | | | x | | | x | x | |
| In-depth treatment of all the immersed parts | | | | | | | | x | |
| Efficacy 3 months | 0 | 0 | ++ | ++ | ++ | +++ | +++ | +++ | +++ |
| Efficacy 6 months | 0 | 0 | 0 | 0 | 0 | ++ | ++ | +++ | +++ |
| Efficacy 12 months | 0 | 0 | 0 | 0 | 0 | 0 | 0 | ++ | +++ |
| Conclusion | The biofilm very swiftly creates problems when there are no treatment means | The copper wire is not sufficient | The unique solutions are efficacious for 3 months at most | | | The combination of solutions work better than single solutions. Efficacious for 4 to 6.5 months | | Efficacious for 7 months in the worst case scenario, 13 months in most cases | Efficacious for 12 months |

Thus, by way of an example, the application, to the walls of a container, of a biocide paint diffusing copper salts and the presence in the container of a large quantity of a silver-plated copper wire prevents the appearance of biocides in a durable way (for about 12 months). It must be noted that the simultaneous implementation of different biocide agents (copper and silver) in the surface treatment and in the wire present in the container could partly explain the efficacy of this solution.

The method proposed by the invention therefore pushes back the appearance of biofilm in a container to at least 12 months while the previously known prior-art techniques push this appearance back to only three months. The solution of the invention therefore appreciably reduces the frequency of the maintenance operations to be performed to remove biofilm from the containers.

In certain embodiments, it is also possible to provide means for generating a movement of condensates inside the container, for example by means of a fan placed in the container.

Such a removal pump can be applied especially in the field of refrigeration systems, for example for supermarket showcases, but also in any installation implementing a condensate removal device in which the biofilm is liable to grow.

An embodiment of the invention provides a technique for efficaciously combating the formation of biofilm, especially in condensate receiving pans, in preventing their appearance during a lengthier period than with the techniques known in the prior art.

An embodiment of the invention provides a technique of this kind that is simple and inexpensive to implement.

An embodiment of the invention provides a technique of this kind that eliminates or at least greatly reduces maintenance costs and requirements, especially for the elimination of biofilms.

An embodiment of provides a technique that causes minimal impact on the environment.

Although the present disclosure has been described with reference to one or more examples, workers skilled in the art will recognize that changes may be made in form and detail without departing from the scope of the disclosure and/or the appended claims.

The invention claimed is:

1. A device for removing condensates comprising:

a container in which condensates are collected, said container having internal immersed walls and internal immersed parts therein; and a removal pump providing for discharge of the condensates present in said container, wherein said internal immersed walls and internal immersed parts are covered with a biocide surface treatment, and wherein said container contains at least one wire element made out of a bactericidal metal material having a diameter of 0.01 mm to 1 mm, and a length chosen so as to provide a contact surface area greater than the surface area of said container in contact with said condensates, wherein said bactericidal metal is silver-plated copper.

2. The device for removing condensates according to claim 1, wherein said wire element takes the form of a coil, a ball, wool, a brush and/or a screen.

3. The device for removing condensates according to claim 1, wherein said wire elements take the form of multi-strand cables.

4. The device for removing condensates according to claim 1, wherein said wire elements are prepared by means of activation and/or acceleration of the bactericidal action of said metal.

5. The device for removing condensates according to claim 1, wherein said biocide surface treatment comprises application of a biocide paint diffusing salts of copper, silver or of an alloy comprising at least one of these two metals.

6. A refrigeration, heating and/or air-conditioning installation comprising at least one device for removing condensates according to claim 1.

7. The device for removing condensates according to claim 1, wherein said wire elements are prepared by means of activation and/or acceleration of the bactericidal action of said metal.

8. A device for removing condensates comprising:

a container in which condensates are collected, said container having walls and immersed parts therein; and a removal pump providing for discharge of the condensates present in said container, wherein an in-depth treatment is applied to said walls and said immersed parts, said in-depth treatment comprising using a biocide additive and/or surface structuring, and wherein said container contains at least one wire element made out of a bactericidal metal material having a diameter of 0.01 mm to 1 mm, and a length chosen so as to provide a contact surface area greater than the surface area of said container in contact with said condensates, wherein said bactericidal metal is silver-plated copper.

9. A refrigeration, heating and/or air-conditioning installation comprising at least one device for removing condensates according to claim 8.

10. The device for removing condensates according to claim 8, wherein said walls are made of a plastic material and wherein said in-depth treatment comprises inserting a biocide additive into the plastic forming the walls and diffusing through the plastic.

11. The device for removing condensates according to claim 8, wherein said wire element takes the form of a coil, a ball, wool, a brush and/or a screen.

12. The device for removing condensates according to claim 8, wherein wire elements take the form of multi-strand cables.

* * * * *